United States Patent [19]

Mircovich et al.

[11] 4,153,827

[45] May 8, 1979

[54] MAGNETIC BLOW-OUT ARC EXTINGUISHING DEVICE

[75] Inventors: Jean-Louis Mircovich, Seyssins; Marcel Macaire, Grenoble; René Charlas, St. Egreve; Gérard Le Floch, Seyssinet, all of France

[73] Assignee: Merlin Gerin, Grenoble, France

[21] Appl. No.: 758,146

[22] Filed: Jan. 10, 1977

[30] Foreign Application Priority Data

Jan. 26, 1976 [FR] France ..... 76 02084
Jan. 26, 1976 [FR] France ..... 76 02087

[51] Int. Cl.[2] ..... H01H 33/66
[52] U.S. Cl. ..... 200/144 B; 200/147 R
[58] Field of Search ..... 200/144 B, 147 R

[56] References Cited

U.S. PATENT DOCUMENTS

| | | | |
|---|---|---|---|
| 1,839,107 | 12/1931 | Mahoney | 200/144 R |
| 2,972,032 | 2/1961 | Persson | 200/147 R |
| 3,017,480 | 1/1962 | Klaassen | 200/146 R |
| 3,038,980 | 6/1962 | Lee | 200/144 B |
| 3,814,882 | 6/1974 | Harrold | 200/144 B |

FOREIGN PATENT DOCUMENTS

| | | | |
|---|---|---|---|
| 921462 | 12/1954 | Fed. Rep. of Germany. | |
| 1440140 | 2/1969 | Fed. Rep. of Germany. | |
| 2511238 | 9/1975 | Fed. Rep. of Germany. | |
| 1527489 | 4/1968 | France. | |
| 45-5087 | 5/1966 | Japan | 200/144 B |
| 825062 | 12/1959 | United Kingdom | 200/144 B |
| 1255943 | 12/1971 | United Kingdom | 200/144 B |

*Primary Examiner*—Robert S. Macon
*Attorney, Agent, or Firm*—Stevens, Davis, Miller & Mosher

[57] ABSTRACT

An arc-extinguishing device comprising two pairs of contacts having ring-shaped paths and connected electrically in series. A magnetic blow-out coil connected in parallel at one pair of contacts produces a radial magnetic field which causes rotation of the arcs along the ring-shaped paths.

4 Claims, 9 Drawing Figures

MAGNETIC BLOW-OUT ARC EXTINGUISHING DEVICE

This invention relates to a magnetic blow-out arc extinguishing device having two pairs of separable contacts and a blow-out coil connected electrically in parallel with one of said pairs.

In prior-art cicuit breakers or contactors, the rapid extinction of the arc drawn between the separated contacts is enhanced by suitable magnetic blow-out means, and it is known to shunt the blow-out coil by auxiliary contacts in the closed circuit position of the circuit breaker, or to energize the coil only at the appearance of an arc by arc transferring means including a connection electrode.

These known devices need particular control means cooperating with said auxiliary contacts, or provide a delayed extinction of the arc causing damage to the contacts such as premature wear.

It is an object of the invention to provide an arc extinguishing device having magnetic blow-out means causing a rapid migration of the arc roots and energized at the appearance of the arc. It is another object of the invention to eliminate any energization of the blow-out coil during the closing operation of the device.

In the arc extinguishing device according to the invention, said two pairs of contacts are electrically connected in series, and said contacts comprise ring-shaped contact paths disposed coaxially to said coil, so that the magnetic field produced by said coil during the opening operation extends radially in each interval arranged between the contact paths, and causes rotation of the arcs drawn between the separated contacts along said ring-shaped paths.

The above and other objects and advantages of the invention will become apparent from the following description of some embodiments of the invention given by way of examples only and shown in the annexed drawings in which.

Figure 1:
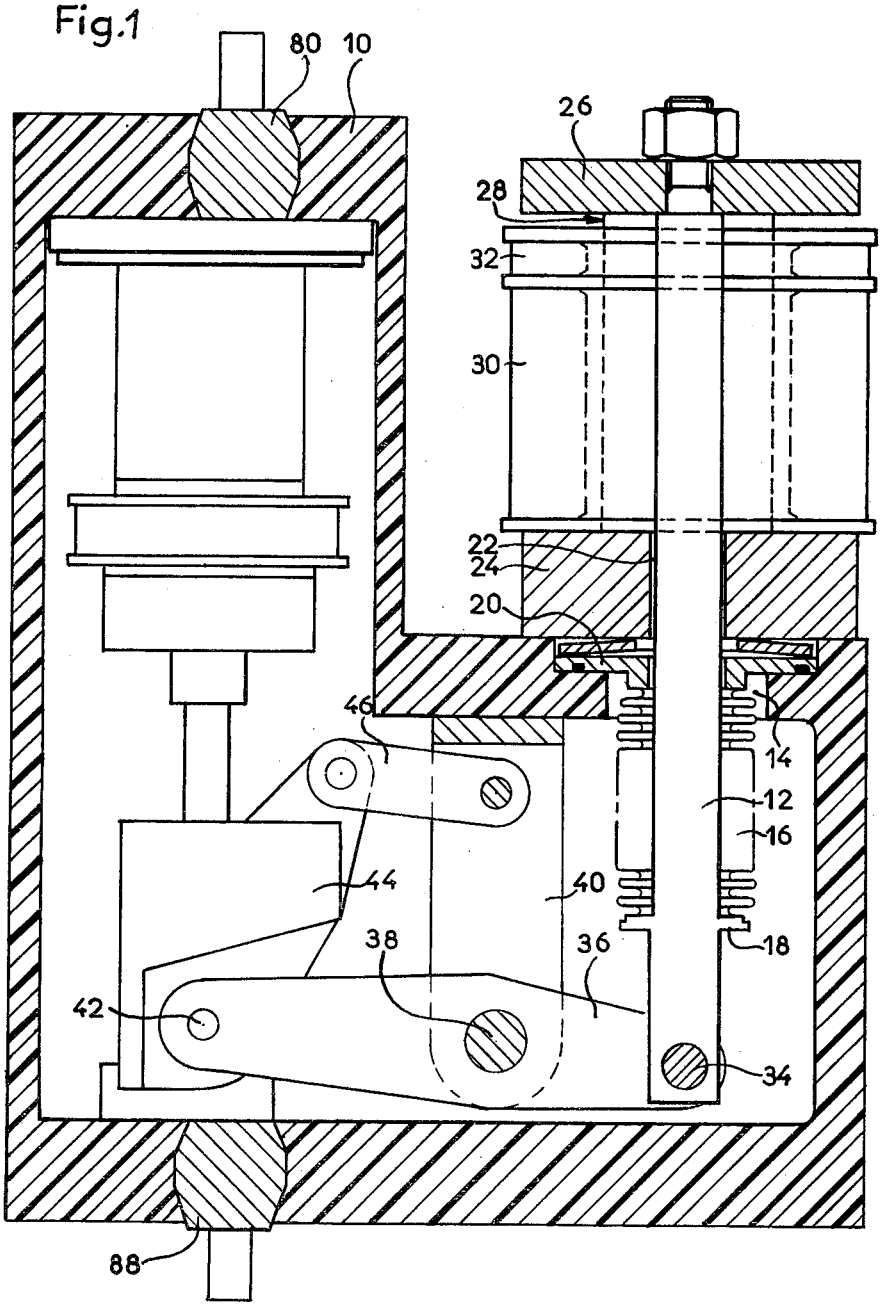
FIG. 1 is a vertical partial sectional view of a contactor equipped with an arc extinguishing device according to the invention.

Referring to the figures, there is shown a contactor comprising a closed housing 10 of a suitable insulating material and filled with pressurized sulfur-hexafluoride. A control rod 12 passes through an orifice 14 arranged in the wall of the housing 10 with interposition of a gastight bellows 16 having one end fixed to a flange 18 of the rod 12 and the opposite end mechanically connected to a closure plate 20 covering the orifice 14. The sliding motion of rod 12 will effect a compression or an expansion of the bellows 16, the inner pressure of the housing 10 acting on the flange 18 so as to exert an upward directed force on the rod 12 which is moved outwardly of the housing 10 towards the open-circuit position of the contactor.

The outer part of the rod 12 is axially surrounded by a U-shaped electromagnet 24 secured to the housing 10 and having a movable armature 26 disposed in front of two stationary poles 28. Each branch of the electromagnet 24 comprises two separate energizing coils constituted by a pulling coil 30 and a holding coil 32.

The opposite end of the rod 12 arranged within the housing 10, is pivotally connected to a pin 34 affixed to a tumbler 36 or rocker-arm rotatably mounted on an axle 38 supported by a stationary bracket 40 secured to the housing 10. The opposite end of the tumbler 36 is articulated on a pin 42 of a slide member 44, guided by a lever 46 pivotally mounted on the stationary bracket 40 so that the sliding motion of the control rod 12 causes an inverse directed translation movement of the slide member 44.

A movable cup-shaped contact 48 having an annular contact surface 50, is axially movable along a rod 52 extending in the translation direction of the slide 44 and including a threaded extremity 54 screwed into the slide member 44. The head of the rod 52 comprises an abutment 56 for holding back the movable contact 48, and a compression spring 58, interposed between the slide member 44 and the contact 48, urges this latter into engagement with the abutment 56. The annular contact surface 50 of the contact 48 cooperates with an associated ring-shaped contact surface 60 secured to the lower face of an intermediate semi-stationary disc 62 of conducting material, the sliding movement of the disc 62 being limited by means of a sleeve 68 affixed to the disc 62 and having an insulating collar 70 coming into abutment after a predetermined stroke with a stationary bracket 64 secured to the housing 10 by screws 66. The opposite upper face of the disc 62 comprises another annular contact surface 72 cooperating with a stationary ring-shaped contact surface 74 secured and electrically connected to the bracket 64. A compression spring 76 bearing upon the bracket 64 urges the sleeve 68 and the associated disc 62 in a position of abutment of said collar 70 and of separation of the pair of stationary and semi-stationary contacts formed respectively by the contact surface 74 and the contact surface 72.

A blow-out or blast coil 78 fastened to the bracket 64 is coaxially disposed with the contact surfaces 60,72, 50,74 so as to produce a radial magnetic field in the two breaking intervals arranged respectively between the two pairs of contact surfaces 50,60;72,74 connected electrically in series.

The bracket 64 of conducting material connects a line terminal connection 80 of the contactor to the stationary ring-shaped contact surface 74, and the ends of the blow-out coil 78 are connected respectively at point 82 to the bracket 64, and to the intermediate semi-stationary disc 62 by a flexible conductor 84. A flexible shunt 86 connects the movable contact 48 to the other line terminal connection 88.

Figure 2:
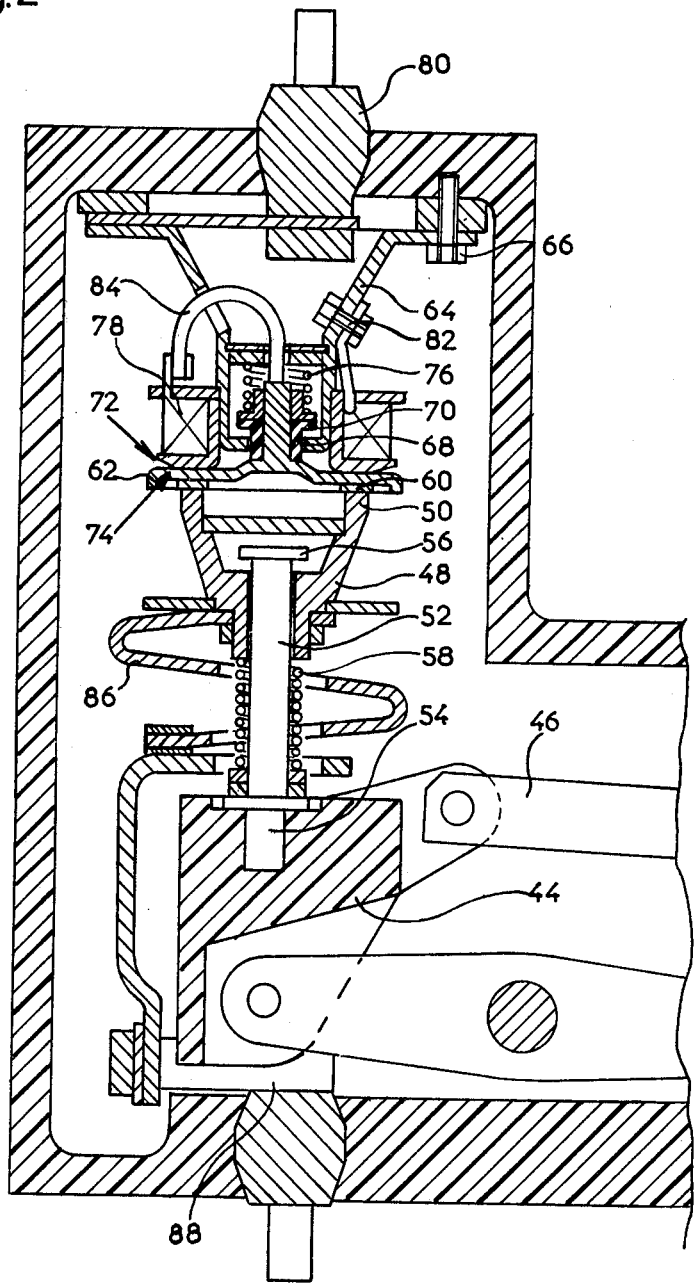
FIGS. 2 and 3 are partial views of FIG. 1 showing in section the contact structure respectively in the closed-circuit and in the open circuit positions.

The working of the contactor operates as follows:

In the closed ciruit position of the contacts shown in FIG. 2, the current enters the contactor through the line terminal connection 80, flows then through the bracket 64, the pair of contacts 72,74, the disc 62, the pair of contacts 60,50, the movable contact 48, the shunt 86, and leaves the contactor through the line terminal connection 88. The blow-out coil 78 is shunted by the pair of closed contacts 72,74 and is not energized. The attraction of the armature 26 resulting from the energization of the series connected coils 30,32, maintains the contactor in the closed position.

The opening of the contactor results from the deenergization of the electromagnet 24 which causes the releasing of the armature 26. The control rod 12 driven by the spring 58 and the pressure acting upon the flange 18, effects an upward opening motion, which through the tumber 36 causes downward opening motion of the movable structure comprising the slide member 44 and the screwed rod 52. When the lost-motion between the abutment 56 and the movable contact 48 has been taken up, the continued opening motion of the screwed rod 52 causes a downward displacement of the movable contact 48. The intermediate disc 62 is driven by the spring 76 so as to follow the movement of the movable contact 48 during a predetermined stroke stopped by the engagement of the collar 70 with the bracket 64. The separation of the contacts 50,60 occurs just after the separation of contacts 72,74 and arcs are drawn in the two breaking intervals between said contacts. The blow-out coil 78 energized by the arc voltage applied between the contacts 72,74, produces in said breaking intervals a radial magnetic field directed traversely of the initial directions of the arcs, so as to cause the rotation of the arc roots around the ring-shaped contact surfaces 50,60; 72,74 to effect the extinction thereof. The extinction of the arc drawn between the contacts 60,50 deenergizes the blow-out coil 78.

As is well known, the arc drawn between the contacts 72,74 acts as a variable resistor. (See IEE Monograph Series 17, Power Circuit Breaker Theory and Design, Flurscheim et al, Chapter 2, Section 2.1). Thus, the voltage drop across the arc resistance in parallel with the impedance of blow-out coil 78 causes the coil to be energized.

During the closing operation of the contactor, the energization of the electromagnet's 24 pulling coil 30 effects the attraction of the armature 26 and a downward closing motion of the control rod 12. In the attracted position of the armature 26 against the poles 28, the holding coil 32 having a high electrical resistance, is inserted in series with the pulling coil 30 so as to reduce the current value in the energizing circuit. The downward translative motion of the control rod 12 effects through the tumbler 36 an upward closing motion of the movable structure, thereby closing the pair of contacts 50,60 during an initial part of the closing operation, and driving then the intermediate disc 62 upwardly to close the pair of contacts 72,74 in a following part of the closing operation. The slide member 44 has a greater stroke than the movable contact 48 causing a slight clearance between the abutment 56 and the movable contact 48, thereby effecting a proper contact pressure in the closed-circuit position. The blow-out coil 78 is energized during a short period corresponding to the closing delay of the shunting contact 72,74.

Figure 4:
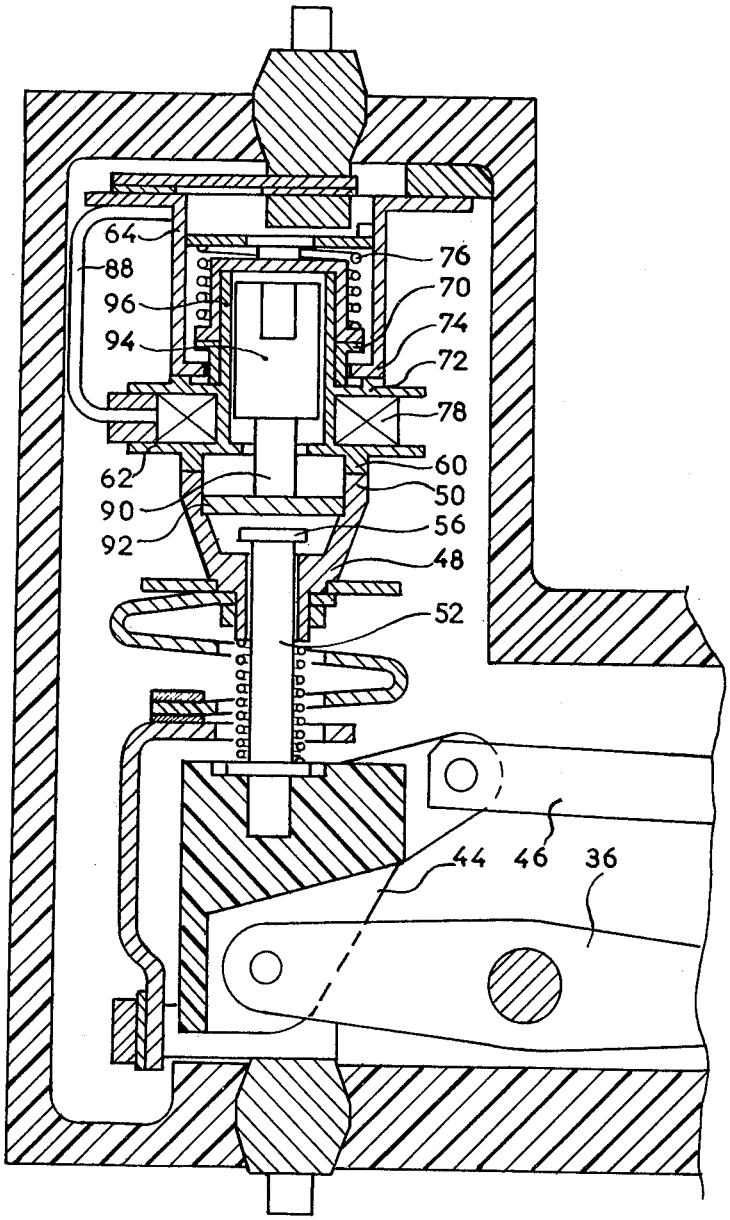
FIGS. 4 and 5 are views similar to FIG. 2, illustrating two other embodiments of the invention.
Figure 5:
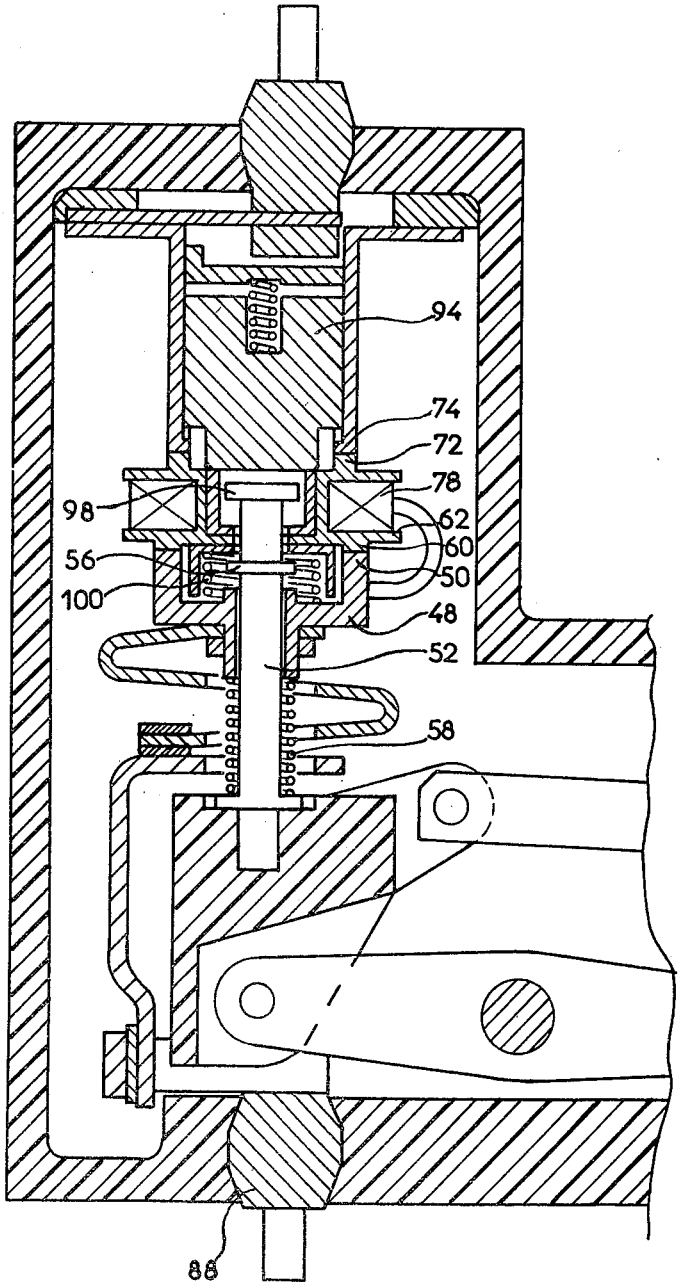

Similar elements denoted by the same reference numbers are used in FIGS. 4 and 5 showing two other embodiments of the invention, having a semi-stationary blow-out coil 78 associated with the disc 62. With reference to FIG. 4, the coil 78 is electrically connected to the bracket 64 by a flexible conductor 88 and to the disc 62, so as to be in parallel with the stationary 74 and semi-stationary 72 shunting contacts. A push-rod 90, bearing upon a plate 92 secured to the movable contact 48, supports a piston 94 structure inserted in a cylinder 96 carried by the disc 62. A slight clearance arranged between piston 94 and cylinder 96 permits air leakage and a relative movement between piston and cylinder.

At the opening of the contactor, the working of the device operates substantially in the same way as the device according to FIG. 2, the mass of the semi-stationary part being however increased by the coil 78 and the push-rod 90. During the closing operation, the push-rod 90 is driven by the movable contact 48, and this operating motion is transmitted to the semi-stationary part by the connection piston 94 within cylinder 96, so as to close in a first phase the contacts 72,74 shunting the blow-out coil 78. The gas leakage between piston 94 and cylinder 96 permits the continued movable contact 48 closing motion, and the collapsing of the connection between the movable contact 48 and the semi-stationary part, thereby effecting the closing of the pair of contacts 50,60. Any energization of the blow-out coil 78 during the closing operation is thus avoided. With reference to FIG. 5, the blow-out coil 78 is also affixed to the semi-stationary member 62, but electrically connected in parallel with the semi-fixed 60 and movable 50 contacts. At the opening the movable contacts 48–50 are driven by the abutment 56 of the screwed rod 52 as already described. The rod 52 has another stop 98 which cooperates with the semi-stationary member 62 after the taking up of a lost-motion having a higher stroke than the lost-motion between the abutment 56 and the movable contact 48. The movable 50 and semi-fixed 60 contacts are urged by a compression spring 100 towards the open position, and the piston 94 cooperates with the semi-stationary member 62 which is braked during the closing operation of the contactor, thereby effecting at first the closing of the contacts 50,60 shunting the coil 78. The working of this device is apparent from the foregoing description.

Figure 3:
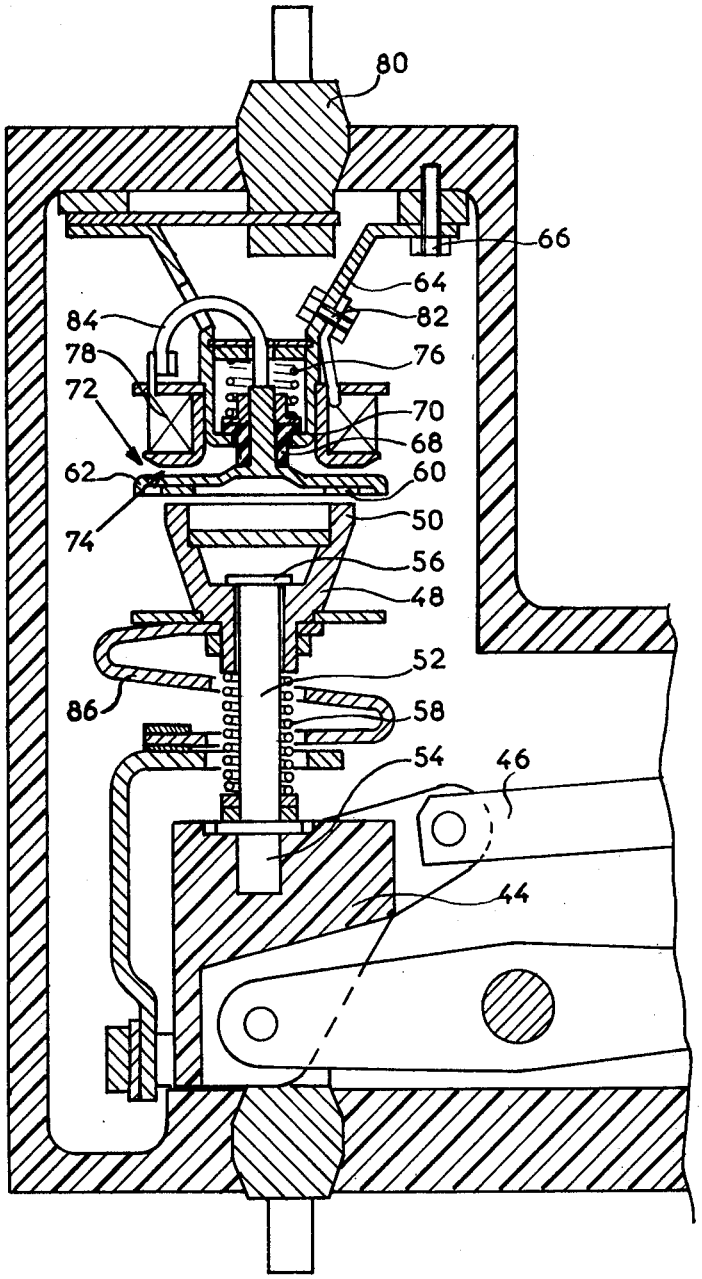
Figure 6:
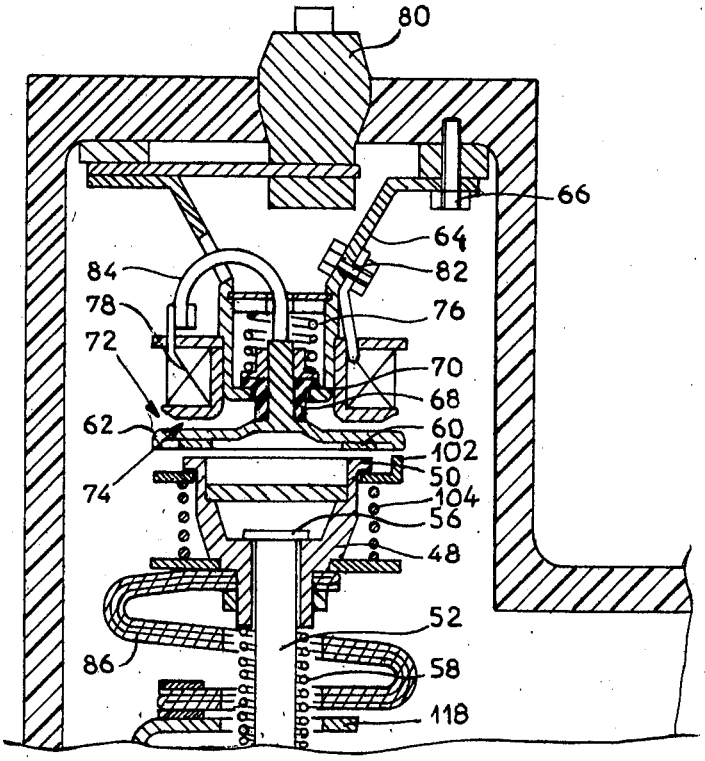
FIG. 6 is a partial view to FIG. 2 showing a further embodiment of the invention.

FIG. 6 shows the device according to FIGS. 2 and 3 having a control device of the opening and closing sequence of the two pairs of contacts 50,60;72,74. The movable contact 50 comprises a push-rod 102 having an end face directed towards the semi-stationary member 62 and projecting in the open circuit position of the contactor beyond the transverse plane passing through the top of the movable contact 50. A spring 104 associated with the push-rod 102, has a greater strength than the spring 76, so that the push-rod 102 makes sliding contacting engagement with the semi stationary member 62 during the closing motion of the movable contact 50, and causes its displacement towards the closed position of the contacts 72,74 prior to the withdrawal of the push-rod 102 effecting the closing of the contacts 50,60. The energization of the blow-out coil 78 is thus avoided during the closing operation, and the contacts 50,60 are opened before the separation of the contacts 72,74 during the opening operation of the contactor.

Figure 7:
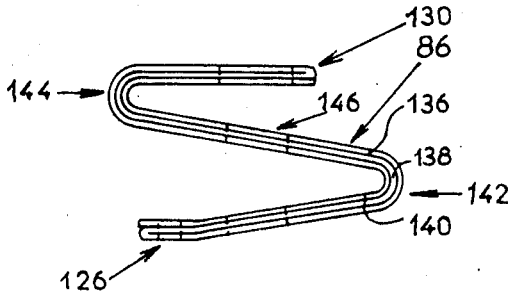
FIG. 7 represents a view of the flexible shunt conductor according to FIG. 6.
Figure 8:
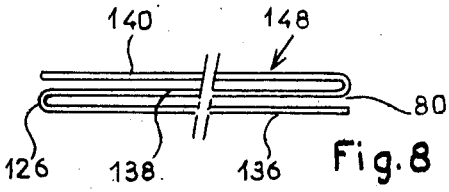
FIGS. 8 and 9 show two embodiments of the conductor according to FIG. 7.
Figure 9:
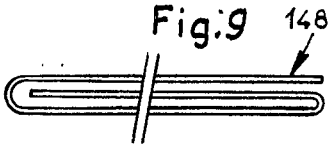

FIGS. 7 to 9 represent different embodiments of the shunt conductor 86 comprising a stacking of three copper sheets 136, 138 and 140 having a slight thickness adapted to a predetermined flexibility. The opposite ends 126, 130 of the sheets 136, 138 and 140 are secured to the terminal 118 and to the movable contact 48, and the sheets can freely slide with respect to each other. The shunt conductor 86 includes a pair of staggered round folds 142, 144 obtained by a zigzag bending operation, and symmetrically arranged with respect to the motion axis of the movable contact 48. The displacement of the contact 48 causes either the compression or the expansion of the folds 142, 144 according to the motion direction. The sheet 140 is respectively inwardly and outwardly located in the folds 142, 144, and the relative length variations between outer and inner sheets of one fold are taken up by the corresponding variations of the other symmetrical fold during their compression or expansion. The shunt conductor 86 has good flexibility, even in the case of a higher thickness, or a different number of stacked sheets and folds. An orifice 146 arranged in the central portion of the conductor 86 permits the passage of the control rod 52 which guides the conductor 86 during its deformation.

All the sheets 136, 138, 140 have the same length. According to a method of manufacture of the shunt conductor 86 shown in FIG. 8, a zigzag folded strip 148 forms three successive layers, each corresponding to one of the three sheets 136, 138, 140. In FIG. 9, the folded strip comprises three flat half turns forming a rectilinear unity which may be folded as shown in FIG. 7.

What we claim is:

1. A magnetic blow-out arc extinguishing device comprising:

two pairs of separable contacts connected electrically in series including a stationary contact having a ring-shaped contact surface, a movable contact having a ring-shaped contact surface and a semi-stationary support member interposed between said stationary and movable contacts and having a first ring-shaped semi-stationary contact surface confronting and cooperating with said ring-shaped contact surface of said stationary contact to form a first pair of contacts and a second ring-shaped semi-stationary contact surface cooperating with said ring-shaped contact surface of said movable contact to form a second pair of contacts, said first and second ring-shaped semi-stationary contact surfaces being connected electrically and mechanically to each other, actuating means for moving said movable contact towards the separated position of said pairs of separable contacts, means for moving said semi-stationary support member to follow said movable contact along a predetermined stroke for separating said first pair of contacts just before said second pair of contacts is separated and drawing arcs between both pairs of contacts, a blow-out coil having a longitudinal axis extending parallel to the path followed by said arcs, said coil having a pair of terminals connected across said first pair of contacts so as to be energized at the appearance of an arc-voltage between the contacts of said first pair and developing a magnetic blow-out field, said ring-shaped contact surfaces on said stationary, semi-stationary and movable contacts being disposed coaxially with the longitudinal axis and outside said coil so that said magnetic field directed substantially radially between said ring-shaped surfaces causes rotation of the arc drawn between the separated contacts of said first pair and of the arc drawn between said second pair of contacts.

2. A magnetic blow-out arc extinguishing device according to claim 1 wherein said coil is rigidly fixed to said stationary contact and said device is provided with an operating linkage element linking said actuating means and said semi-stationary support member so that said first pair of contacts closes prior to the closing of said second pair of contacts, said coil being de-energized during the closing operation of said contacts.

3. A magnetic blow-out arc extinguishing device according to claim 1 which includes a closed housing filled with sulfur hexafluoride, and wherein are located said pairs of contacts and said blow-out coil, said actuating means having an actuating rod extending out of said housing.

4. A magnetic blow-out arc extinguishing device according to claim 2 which includes a closed housing filled with sulfur hexafluoride, and wherein are located said pairs of contacts and said blow-out coil, said actuating means having an actuating rod extending out of said housing.

* * * * *